United States Patent [19]

Properzi

[11] 4,033,405

[45] July 5, 1977

[54] CASTING WHEEL FOR A CONTINUOUS CASTING MACHINE OF THE WHEEL AND BELT TYPE

[76] Inventor: Giulio Properzi, Via Pietro Cossa, 1, Milan, Italy

[22] Filed: Nov. 17, 1975

[21] Appl. No.: 632,877

[30] Foreign Application Priority Data

Dec. 2, 1974 Italy ..... 30083/74

[52] U.S. Cl. ..... 164/278; 164/87

[51] Int. Cl.[2] ..... B22D 11/06

[58] Field of Search ..... 164/78, 278, 348, 89, 164/87, 276, 277; 64/30 R, 30 C

[56] References Cited

UNITED STATES PATENTS

| | | | |
|---|---|---|---|
| 3,279,000 | 10/1966 | Cofer | 164/87 X |
| 3,464,484 | 9/1969 | Bray | 164/278 |
| 3,536,126 | 10/1970 | Lenaeus | 164/278 |
| 3,642,055 | 2/1972 | Nighman | 164/283 MS X |
| 3,732,045 | 5/1973 | George | 425/DIG. 55 X |

*Primary Examiner*—Ronald J. Shore
*Assistant Examiner*—John S. Brown
*Attorney, Agent, or Firm*—Guido Modiano; Albert Josif

[57] ABSTRACT

There is disclosed a casting wheel for a continuous casting machine of the wheel and belt type, the wheel having two flanges, at least one of which being a drive flange supporting a casting ring mechanically coupled thereto by means of a plurality of cavities provided peripherally in the flange and open towards the inside of the wheel and by clamp means arranged in these cavities and clamping the peripheral rim of the flange with the possibility of relative movement between the casting ring and the flange under thermal expansion and contraction. The clamping may occur by interposition of inserts of wear-resistant material. The clamp means may be made of two parts held together by resilient means and may be housed in the cavities with a certain radial and axial clearance to be themselves displaceable.

5 Claims, 2 Drawing Figures

CASTING WHEEL FOR A CONTINUOUS CASTING MACHINE OF THE WHEEL AND BELT TYPE

BACKGROUND OF THE INVENTION

This invention relates to a casting wheel for a continuous casting machine of the wheel and belt type, in which the casting wheel has a casting ring mechanically coupled to a drive flange of the casting wheel.

In a machine of this type in which the molten metal is continuously cast into the casting ring closed over a certain arc by the metal belt, and is extracted in the form of a continuous bar where the belt leaves the ring, the drive flange and casting ring are subjected to different thermal conditions and hence to different states of expansion.

In this respect, at any moment during casting, the temperature pattern along the ring periphery is given by a curve which descends in a manner proportional to the quantity of heat removed from the ring and metal, this curve having a maximum at the point in which the molten metal is cast into the ring and a minimum in the zone in which the ring is free from metal.

The behaviour of the temperature at any point as a function of time is given by a curve identical with that heretofore described when the ring is rotating. The expansion of any ring portion induced by such a temperature condition is thus periodic, with a period corresponding to one revolution of the wheel.

The temperature pattern along the periphery of the drive flange is however practically constant.

These different temperature conditions generate a different deformation in the flange and ring. Thus while the drive flange practically maintains its original constructional shape, i.e. circular, under working conditions as the expansion is practically identical for each sector of the flange, the casting ring would, if not constrained by the flange, assume a geometrical form considerably deviating from the circular form, and generated by a continuous variation in the radius of curvature, which would determine a non-symmetrical ovalisation of the casting ring.

However in practice the ring is constrained by the drive flange, because of which the ring is obliged to maintain a geometrical configuration equal to that of the drive flange to which it is rigidly coupled, and therefore preserves a shape essentially equal to its original shape. This gives rise to tractive and compressive stresses between the flange and ring and to internal stresses in the ring, which not only lead to rapid ageing of the ring because of the periodicity of these stresses, but also in some cases to fracture of the coupling members.

In particular, where the coupling is obtained by a slot and key, in practice the slot in the casting ring often breaks because of the difference in the circumferential expansion of the portion between one slot and the next in the casting ring and drive flange respectively.

SUMMARY OF THE INVENTION

The fundamental object of the present invention is to provide a casting wheel of the type initially specified, in which the mechanical coupling between the drive flange and casting ring is such as to eliminate tractive and compressive stresses in the material of the two members due to their different expansion, without prejudicing proper torque transmission from the drive flange to the ring, and with the advantage of increasing the life of the material and avoiding fracture of the coupling members.

This object is attained by a casting wheel according to the invention wherein at least the drive flange comprises a plurality of cavities distributed at its periphery and open towards the inside of the casting wheel, in these cavities there being housed clamps which engage under pressure with the peripheral surface of the casting ring in a manner permitting relative movement.

In an embodiment of this type, in which relative movement between points of the casting ring and points of the drive flange is permitted, any expansion of the casting ring may take place independently of the expansion of the flange and without prejudicing proper torque transmission between the drive flange and the casting ring. Because of this free expansion the stresses in the materials and coupling members are eliminated, with consequent increase in the life not only of the ring but of the entire casting wheel.

BRIEF DESCRIPTION OF THE DRAWINGS

Further characteristics of the invention will be more evident from the subclaims and from the description given hereinafter by way of example of a preferred embodiment of the invention, illustrated in the accompanying drawings in which:

DESCRIPTION OF THE PREFERRED EMBODIMENT

Figure 1:
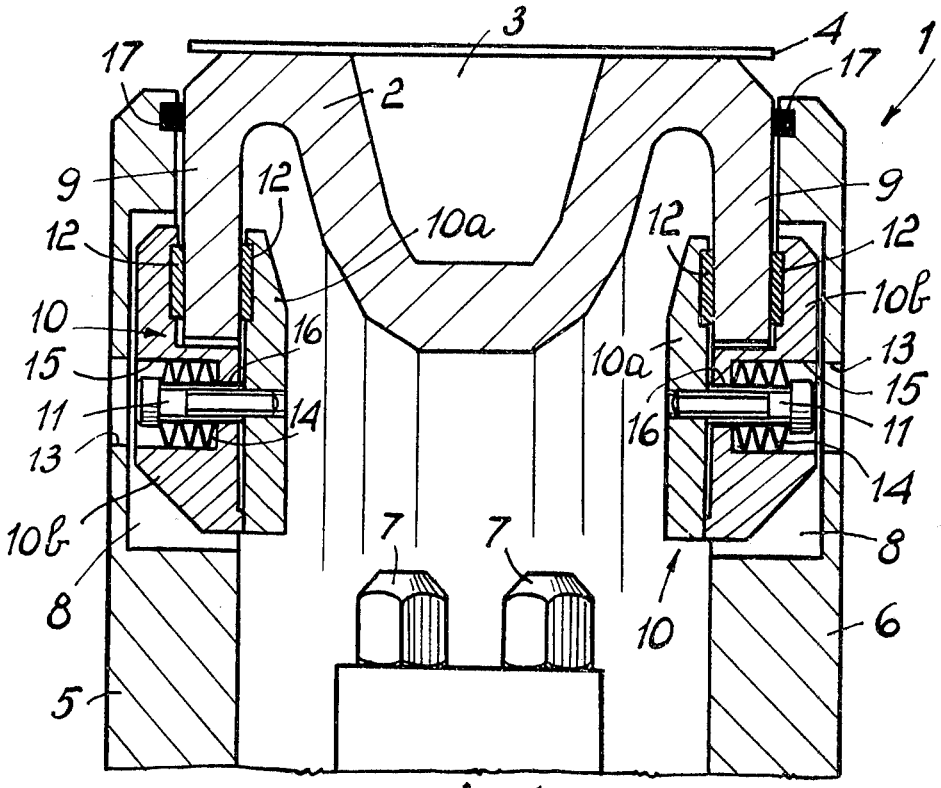
FIG. 1 is an axial cross-section through the peripheral part of a casting wheel according to the invention.

The casting wheel 1 comprises, in known manner, a casting ring 2 defining a mold 3 for the molten metal and closed over a certain arc by a metal belt 4. The casting ring 2 is supported by two flanges, 5 and 6 respectively, of which one is the drive flange, connected to the drive shaft of the casting wheel (not shown) in a rotatably rigid manner. It is however possible to also make the other flange a drive flange by connecting it to the drive shaft as described for example in my copending U.S. patent application Ser. No. 516.839 with the advantage of a more uniform force distribution. The nozzles for the cooling liquid for the ring 2 are indicated by the reference numeral 7.

According to the invention at least the drive flange (and also the other flange in the case illustrated by way of example, independently of whether it is connected to the drive shaft or not) comprises a plurality of cavities 8 distributed at the flange periphery and open towards the interior of the casting wheel 1. The cavities 8 are advantageously of parallelepiped form and extend radially over a height sufficient to contain the terminal part of the peripheral rims 9 of the casting ring 2.

Inside each cavity 8 is housed a clamp 10 which has two spaced parts clamping projections engaging therebetween by friction the peripheral rim 9 of the casting ring 2 and permitting relative movement between the casting ring 2 and the drive flange. In a particularly advantageous embodiment of the invention, each clamp 10 consists of two parts, **10*a* and 10*b* respectively, held together by at least one screw 11 and arranged substantially on opposite sides of the peripheral rim 9 of the casting ring 2. Each of the two parts has one face facing a porton of the rim 9 comprising at least one insert 12 of wear-resistant material projecting from the face. On tightening the screw, through aperture 13 provided in the flange, the inserts 12 are compressed against the peripheral surface of the rim 9 and against their housing in the respective parts of the clamp 10.**

In a further development of the invention, the compression between the clamps 10 and rims 9 may be predetermined by disposing a spring assembly 14 between the head of the screw 11 and the base of a cavity 15 formed in one of the two parts of the clamps 10. A spaced sleeve 16, having one end engaged with that part of the clamp 10 in which the screw 11 isd screwed, determines the limit of travel of the screw 11 and hence the maximum deflection of the spring assembly 14 corresponding to the required pressure.

The seal gaskets between the ring and flange are indicated by the reference numeral 17.

In further development of the invention, each clamp 10 has a dimension in radial direction of the casting wheel advatageously less than the radial dimension of the cavity 8 and a dimension in the circumferential direction of the flange substantially equal to the circumferential extension of the cavity 8.

Torque transmission between the drive flange and casting ring 2 is obtained through the contact between the side of each cavity and the side of the respective clamp, which rotates together with the flange and drives the casting ring by friction.

A coupling of the type described attains the initial object in that it does not constitute a rigid mechanical constraint between the drive flange and the casting ring but a constraint which permits an elongation of any ring portion different from the elongation of the corresponding portion of the drive flange, so allowing the ring to assume a configuration different from its originally constructed shape, as a function of the thermal expansion at any moment.

The constraint formed by the inserts of friction material is such that the constrained point may change continuously in relation to the temperature pattern in the particular ring portion. A temperature increase in any ring portion therefore results in a free elongation rather than a tractive or compressive stress, as this protion is no longer rigidly constrained by the flange.

Figure 2:
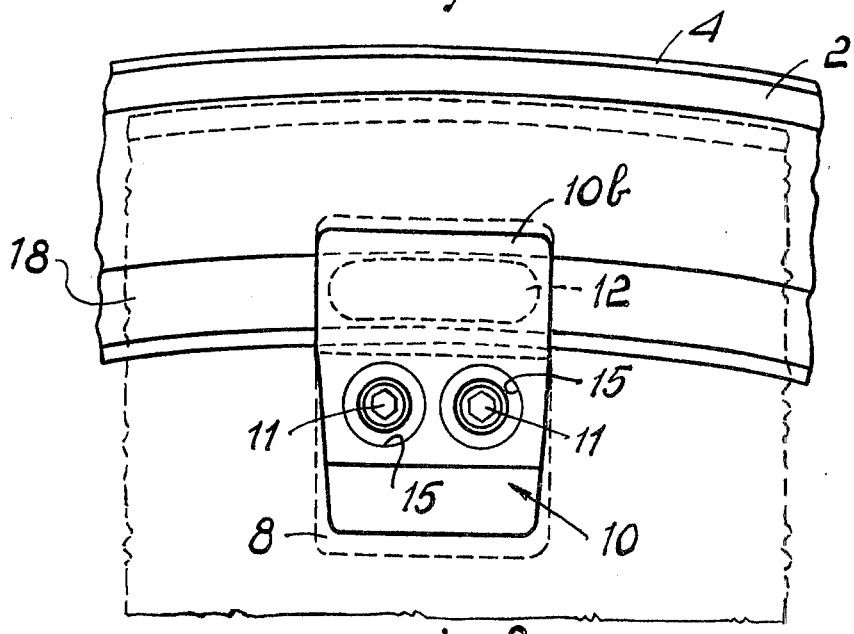
FIG. 2 is a side view of part of the casting wheel according to the invention, in which the drive flange is shown by a dashed line for ease of illustration.

If the drive clamp is made with a radial dimension less than the radial dimension of the cavity in the flange, it is also free in the cavity in the radial directon, and can therefore follow the casting ring in its radial deformation. In this case the peripheral rim 9 of the casting ring may be provided with a continuous annular groove 18, as shown in FIG. 2, so that the wear-resistant inserts 12 engage the casting ring 2 by friction within this groove. The clamp is also free towards the interior of the casting wheel, because of which it can also follow the deformation in this direction of the casting ring rims consequent on the expansion of the central part of the ring cross-section due to the temperature increase at the moment of contact with the molten metal.

The invention described is susceptible to numerous modifications falling within the scope of the inventive idea. Thus, as already mentioned, the clamps may also be provided for the flange other than the drive flange. It is further possible to make the cavities open also towards the wheel exterior. The clamps may also have dimensions substantially corresponding to the cavity dimensions (leaving out of consideration the necessary constructional tolerances), as relative expansion between the flange and ring is always possible because of the pressure engagement between the clamps and the peripheral ring surface.

I claim:

1. A casting wheel for a continuous casting machine of the wheel and belt type, having at least one drive flange and a casting ring mechanically coupled thereto, wherein at least said drive flange comprises a plurality of cavities distributed at its periphery and open towards the interior of the casting wheel, the casting wheel further comprising a plurality of clamp means each housed in a corresponding one of said cavities and each having two spaced apart clamping projections engaging therebetween by friction a peripheral rim of said casting ring and permitting relative movement between said casting ring and said drive flange.

2. A casting wheel as claimed in claim 1, further comprising inserts of wear-resistant material interposed between said spaced clamping projections and said peripheral rim.

3. A casting wheel as claimed in claim 1, wherein said clamp means comprise two parts substantially disposed on opposite sides of said peripheral rim of the casting ring, connection means for holding together said parts, and resilient members interposed between said parts, the resilient force of said resilient members being adjustable by adjusting said connection means.

4. A casting wheel as claimed in claim 1, wherein said clamp means have a radial dimension smaller than the radial dimension of said cavities, and a dimension in the circumferential direction of said flange substantially equal to the circumferential extension of said cavities.

5. A casting wheel as claimed in claim 4, wherein said peripheral rim has a continuous annular groove for receiving inserts of wear-resistant material secured to said clamp means.

* * * * *